US007507188B2

(12) United States Patent
Nurre

(10) Patent No.: US 7,507,188 B2
(45) Date of Patent: Mar. 24, 2009

(54) REHAB CYCLE CRANK

(76) Inventor: Christopher G. Nurre, 728 Joyce St., Billings, MT (US) 59105

( * ) Notice: Subject to any disclaimer, the term of this patent is extended or adjusted under 35 U.S.C. 154(b) by 503 days.

(21) Appl. No.: 11/379,461

(22) Filed: Apr. 20, 2006

(65) Prior Publication Data

US 2007/0249471 A1 Oct. 25, 2007

(51) Int. Cl.
*A63B 69/16* (2006.01)

(52) U.S. Cl. ..... 482/57; 482/59; 74/594.3; 74/594.4

(58) Field of Classification Search ..... 482/51, 482/57–59, 148, 908; 74/560, 562, 562.5, 74/594.1, 594.3, 594.4, 594.5, 594.7, 595, 74/600

See application file for complete search history.

(56) References Cited

U.S. PATENT DOCUMENTS

| | | | | | |
|---|---|---|---|---|---|
| 935,495 | A | | 9/1909 | Grout | |
| 2,337,246 | A | * | 12/1943 | Kelly | 74/594.7 |
| 3,307,425 | A | * | 3/1967 | Sykes et al. | 74/594.7 |
| 3,457,803 | A | * | 7/1969 | Sykes et al. | 74/594.7 |
| 3,922,929 | A | * | 12/1975 | Marchello | 74/562 |
| 4,606,241 | A | | 8/1986 | Gredriksson | |
| 4,973,046 | A | * | 11/1990 | Maxwell | 482/60 |
| 5,070,744 | A | * | 12/1991 | Wu | 74/594.3 |
| 5,261,294 | A | | 11/1993 | Ticer et al. | |
| 5,324,241 | A | * | 6/1994 | Artigues et al. | 482/57 |
| 5,573,481 | A | | 11/1996 | Piercy et al. | |
| 5,636,554 | A | * | 6/1997 | Amey | 74/594.3 |
| 5,860,329 | A | * | 1/1999 | Day | 74/594.1 |
| 6,474,193 | B1 | | 11/2002 | Farney | |
| 6,589,139 | B1 | | 7/2003 | Butterworth | |
| 6,640,662 | B1 | * | 11/2003 | Baxter | 74/594.3 |
| 6,820,517 | B1 | | 11/2004 | Farney | |
| 7,097,597 | B2 | * | 8/2006 | Tamian | 482/57 |
| 7,204,788 | B2 | * | 4/2007 | Andrews | 482/57 |
| 2005/0020411 | A1 | | 1/2005 | Andrews | |

* cited by examiner

*Primary Examiner*—Jerome Donnelly
*Assistant Examiner*—Tam Nguyen
(74) *Attorney, Agent, or Firm*—Antoinette M. Tease

(57) ABSTRACT

A rehab cycle crank having a pedal assembly, center assembly, anchor assembly, two rods, and pneumatic cylinder; wherein the pedal assembly includes a pedal plate, pedal base, and housing; wherein the center assembly includes a primary member and a secondary member; wherein each rod includes a first end and a second end; wherein the pneumatic cylinder includes a first end and a second end; wherein the housing of the pedal assembly is connected to the first end of each rod; wherein the anchor assembly is connected to the second end of at least one of the rods and the second end of the pneumatic cylinder; wherein the rods extend slidably through the primary member of the center assembly; wherein the primary member is attached to the secondary member by a central hub; wherein the secondary member comprises a crank arm into which the crank spindle of a cycle is inserted.

16 Claims, 14 Drawing Sheets

REHAB CYCLE CRANK

BACKGROUND OF THE INVENTION

1. Field of the Invention

The present invention relates generally to the field of rehabilitation devices and, more specifically, to a cycle crank for use with patients with limited joint mobility.

2. Description of the Related Art

A number of rehab cycle cranks have been patented, but none with the particular combination of adjustability features of the present invention. Several examples are discussed below.

U.S. Pat. No. 935,495 (Grout, 1909) describes a variable throw cycle crank in which the length of the throw is variable by means of a cam-disk. The cam-disk causes the overall throw of the crank (measured as the distance between the pedal and the crank-shaft) to decrease on the up stroke and increase on the down stroke.

U.S. Pat. No. 4,606,241 (Fredriksson, 1986) provides an adjustable crank assembly comprising a hub assembly, a crank lever, a pivot arm, an adjustment member, a pedal, and an anchorage means for positioning the pedal on the pivot arm. A bearing arrangement is fixedly locked in any position along the adjustment member, and the anchorage is releasably locked into place on the pivot arm. By thus moving the position of the bearing arrangement on the adjustment member and the anchorage on the pivot arm, both the diameter of the cranking movement and the vertical position of the cranking movement can be adjusted.

U.S. Pat. No. 5,261,294 (Ticer et al., 1993) describes an adjustable elliptical crank mechanism which operates by means of a sleeve member that is disposed around a first shaft. The sleeve member is connected to a rotating arm, and an attachment means slides along the rotating arm. A first linkage means connects the first shaft and the attachment means, and a second linkage means connects first shaft and the sleeve member. The first and second linkage means allow the attachment means to selectively describe any of a range of circular or elliptical paths.

U.S. Pat. No. 5,573,481 (Piercy et al., 1996) describes a foot-operated therapeutic device in which the position of the pedal is adjustable relative to the pedal axis and the position of the pedal axis is adjustable relative to the saddle. By moving the pedal closer to the pedal axis, the diameter of rotation of the foot is reduced. By moving the pedal axis further away from the saddle, the device can accommodate a patient with a more limited range of motion.

U.S. Pat. No. 6,474,193 (Farney, 2002) and U.S. Pat. No. 6,820,517 (Farney, 2004) provide a pedal crank with a cam and a cam channel (much like the '495 patent discussed above), a hub fixed to the shaft of an exercise machine, and an arm that operates with a cam follower and a pair of rods. The arm includes the pedal of the exercise machine, and the cam follower extends into the channel of the cam. The pedal crank is extended on the down stroke to the maximum length of the rods and retracted on the upstroke, thereby alleviating some of the stress on the hip and knee joints.

U.S. Pat. No. 6,589,139 (Butterworth, 2003) describes a rehab cycle with a primary and a secondary crank that can be adjusted in relation to each other to allow for more passive movement on one side of the cycle and more dynamic movement on the other. Rotation of the secondary crank can be permitted or prevented relative to the primary crank, depending on the nature of disabilities or injuries of the user of the cycle.

U.S. Patent Application No. 2005/0020411 (Andrews) discloses a pedal stroke adjuster for cycles that selectively changes the diameter of the orbit traveled by the foot pedal to compensate for individuals with physical impairments that limit foot movement. A track member is secured to the cycle crank arm, and the pedal is fastened to a slider that is travelable to any of a plurality of different locations along the track member.

None of the above inventions possesses the combination of adjustability features and provides the smooth cadence afforded by the rehab crank of the present invention.

BRIEF SUMMARY OF THE INVENTION

The present invention is a rehab cycle crank comprising a pedal assembly, a center assembly, an anchor assembly, two rods, and a pneumatic cylinder; wherein the pedal assembly comprises a pedal plate, a pedal base, and a housing; wherein the center assembly comprises a primary member and a secondary member; wherein the anchor assembly comprises at least one support piece; wherein each rod comprises a first end and a second end; wherein the pneumatic cylinder comprises a first end and a second end; wherein the housing of the pedal assembly is connected to the first end of each rod; wherein the anchor assembly is connected to the second end of at least one of the rods and the second end of the pneumatic cylinder; wherein the rods extend slidably through the primary member of the center assembly; wherein the primary member is attached to the secondary member by a central hub; wherein the secondary member comprises a crank arm; wherein the crank arm comprise a crank spindle opening; wherein the rehab cycle crank attaches to a cycle that has a crank spindle; and wherein the crank spindle of the cycle is inserted into the crank spindle opening of the crank arm.

In one embodiment, the present invention further comprises a chain ring, and the chain ring is attached to the secondary member by a plurality of bolts. In a preferred embodiment, the present invention further comprises at least one spacer between the secondary member and each bolt.

Preferably, the present invention further comprises two springs, wherein the springs are located on the rods between the housing of the pedal assembly and the primary member. Alternately, the present invention further comprises two rubber bumpers, wherein the rubber bumpers are located on the rods between the housing the pedal assembly and the primary member. In yet another alternate embodiment, the present invention further comprises two limitation collars, wherein the limitation collars are located on the rods between the housing of the pedal assembly and the primary member.

The present invention optionally comprises two or more brass bushings, wherein the brass bushings provide lubrication for the rods as they slide through the primary member.

Preferably, the present invention further comprises two limitation collars, wherein one limitation collar is located on each rod between the primary member and the anchor assembly, and wherein the position of the limitation collars on the rod can be adjusted. The present invention preferably further comprises two springs, wherein the springs are located on each rod between the primary member and the limitation collar. The present invention preferably further comprises two rubber bumpers, wherein the rubber bumpers are located on each rod between the primary member and the limitation collar.

Preferably, the present invention further comprises two or more set screws, wherein the set screws are located on the primary member, and wherein the set screws can be loosened or tightened to make it easier or harder to slide the rods through the primary member.

The pneumatic cylinder preferably comprises an air intake value and an air outlet valve, wherein the ease with which the pneumatic cylinder extends and/or retracts can be adjusted by adjusting the air intake and/or air outlet valves.

In a preferred embodiment, the primary member comprises two arcuate slots, wherein in addition to being attached to the secondary member by a central hub, the primary member is also attached to the secondary member by two screws that extend through the slots in the primary member and into the secondary member, and wherein the angle of the crank when it is installed on a cycle can be adjusted by loosening the screws, rotating the primary member in relation to the secondary member, and retightening the screws.

In a preferred embodiment, the pedal plate comprises a slot, wherein the pedal plate is attached to the pedal base by one or more screws that extend through the slot in the pedal plate and into the pedal base, wherein the position of the pedal plate on the pedal base can be adjusted by loosening the screws, sliding the pedal plate laterally on the pedal base, and retightening the screws. In another preferred embodiment, the pedal plate comprises a slot, wherein the pedal plate is attached to the pedal base by one or more screws that extend through the slot in the pedal plate and into the pedal base, and wherein the position of the pedal plate on the pedal base can be adjusted by loosening the screws, moving the screws to a second position from a first position, and retightening the screws.

REFERENCE NUMBERS

Figure 1:
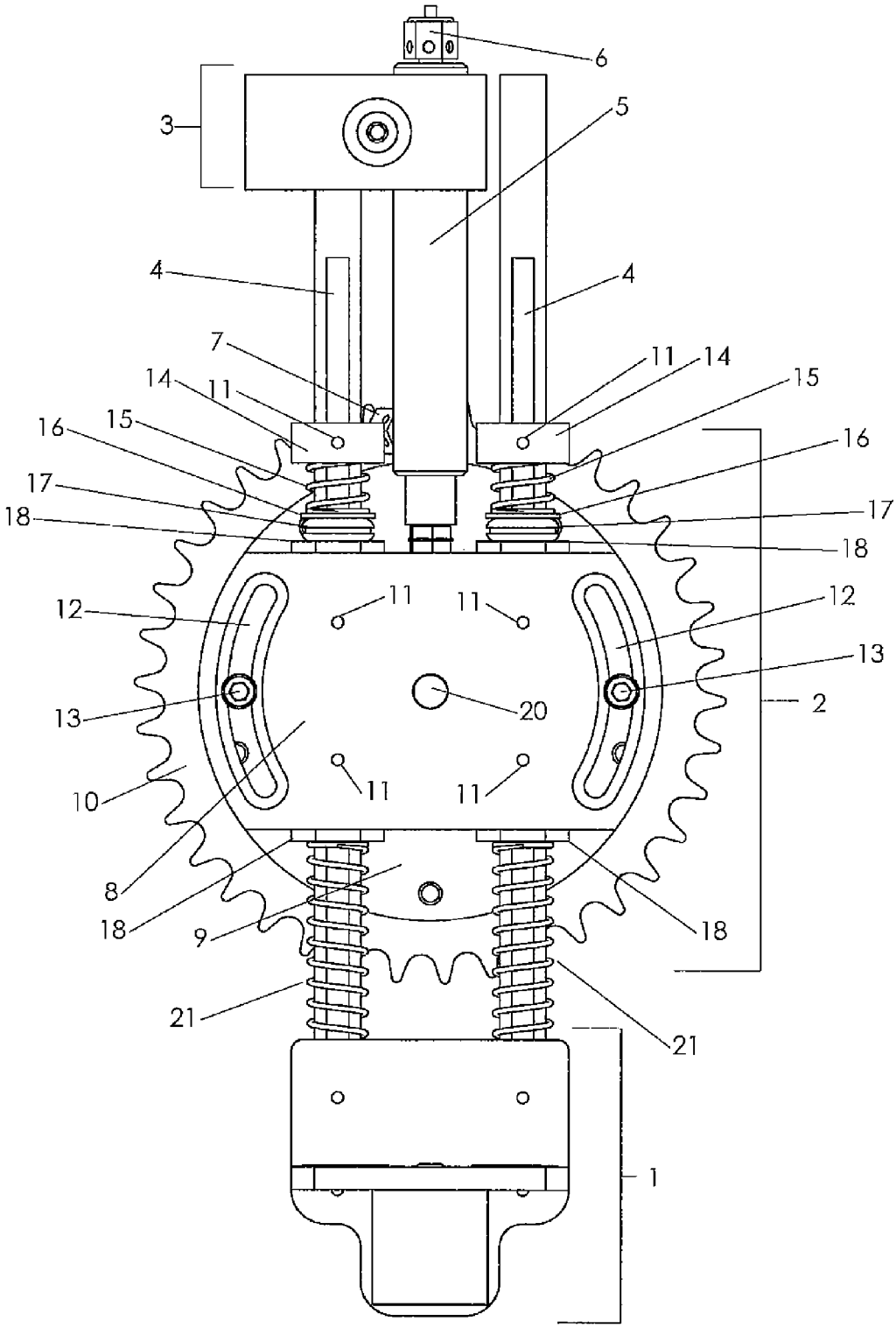
FIG. 1 is a front view of the rehab crank of the present invention.

1 Pedal assembly
2 Center assembly
3 Anchor assembly
4 Rod
5 Pneumatic cylinder
6 Air intake valve
7 Air outlet valve
8 Primary member
9 Secondary member
10 Chain ring
11 Set screw
12 Slot (on primary member)
13 Adjustment screw
14 Limitation collar
15 First spring
16 Washer
17 Rubber bumper
18 Brass bushing
19 Pedal spindle
20 Central hub
21 Second spring
22 Bolt
23 Cutout
24 Crank arm
25 Crank spindle opening
26 Holding screw
27 Pedal plate
28 Pedal base
29 Housing
30 Slot (on pedal plate)
31 Pedal screw
32 Screw hole
33 Spindle bolt
34 Window
35 Measurement scale
36 Spacer
37 Cycle chain
38 Support piece
39 Anchor screw
40 Pedal (on opposite side of cycle)

DETAILED DESCRIPTION OF INVENTION

FIG. 1 is a front view of the rehab crank of the present invention. The rehab crank comprises a pedal assembly 1, a center assembly 2, and an anchor assembly 3. It also comprises two rods 4 and a pneumatic cylinder 5. Both rods 4 are connected to the pedal assembly 1 on one end, and one of the rods is connected to the anchor assembly 3 at the other end. A pneumatic cylinder 5 is connected at one end to the center assembly 2 (more specifically, the primary member 8) and at the other end to the anchor assembly 3. The pneumatic cylinder has an air intake valve 6 and an air outlet valve 7.

The center assembly 2 comprises a primary member 8, a secondary member 9, and a chain ring 10. As illustrated more fully in FIGS. 16 and 17, both rods 4 slidably extend through the primary member 8 of the center assembly 2. The ease with which the rods 4 slide through the primary member 8 can be adjusted by either tightening or loosening the four set screws 11 on the primary member 8. The primary member 8 comprises two arcuate slots 12 through which two adjustment screws 13 attach the primary member 8 to the secondary member 9. The function of the adjustment screws 13 in advancing the rehab crank will be discussed in connection with FIGS. 14 and 15.

Figure 16:
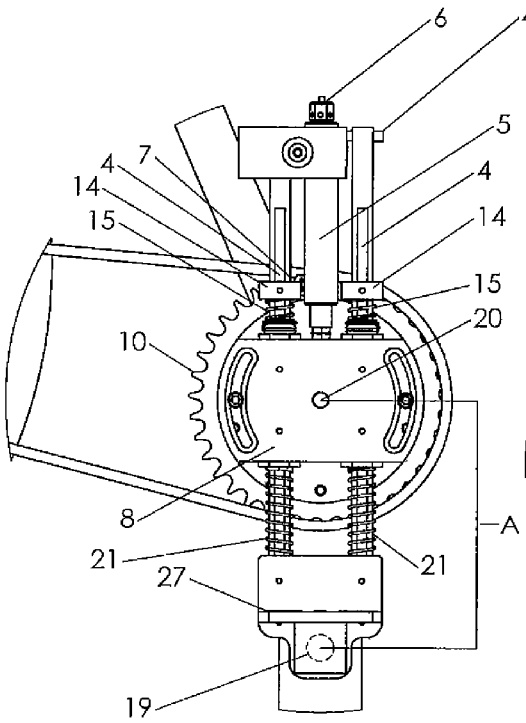
FIG. 16 is a detail view of the rehab crank of the present invention installed on a cycle with the pedal in the down stroke position.

A limitation collar 14 is disposed on each rod 4 between the anchor assembly 3 and the center assembly 2. Between each limitation collar 14 and the primary member 8 of the center assembly 2 is a first spring 15, a washer 16, a rubber bumper 17, and a brass bushing 18. As illustrated in FIG. 16, the purpose of the rubber bumpers 17 is to avoid a banging noise from occurring on the down stroke. The purpose of the washers 16 is to protect the rubber bumpers 17 from being worn down the by first springs 15. The purpose of the first springs 15 is to provide some resistance on the down stroke.

The purpose of the limitation collars 14 is to determine the length of the crank, as measured by the distance between the pedal spindle 19 (see FIG. 2) and the central hub 20, when the crank is fully extended on the down stroke (see distance "A" in FIG. 16). The limitation collars 14 are positioned on the rods 4 by set screws 11, and the limitation collars 14 can be moved up or down on the rods 4 by loosening and tightening the set screws 11.

The brass bushings 18 extend down into the primary member 8 and serve the purpose of providing lubrication for the rods 4 as they slide through the primary member 8. There are also two brass bushings 18 on the other side of the primary member 8, between the primary member 8 and the second springs 21. The purpose of the second springs is to limit how far the crank will compress, as measured by the distance between the pedal spindle 19 (see FIG. 2) and the central hub 20, on the up stroke (see distance "B" in FIG. 17). The second springs 21 are optional. Limitation collars 14 or rubber bumpers 17 could be used in lieu of the second springs 21.

Figure 7:
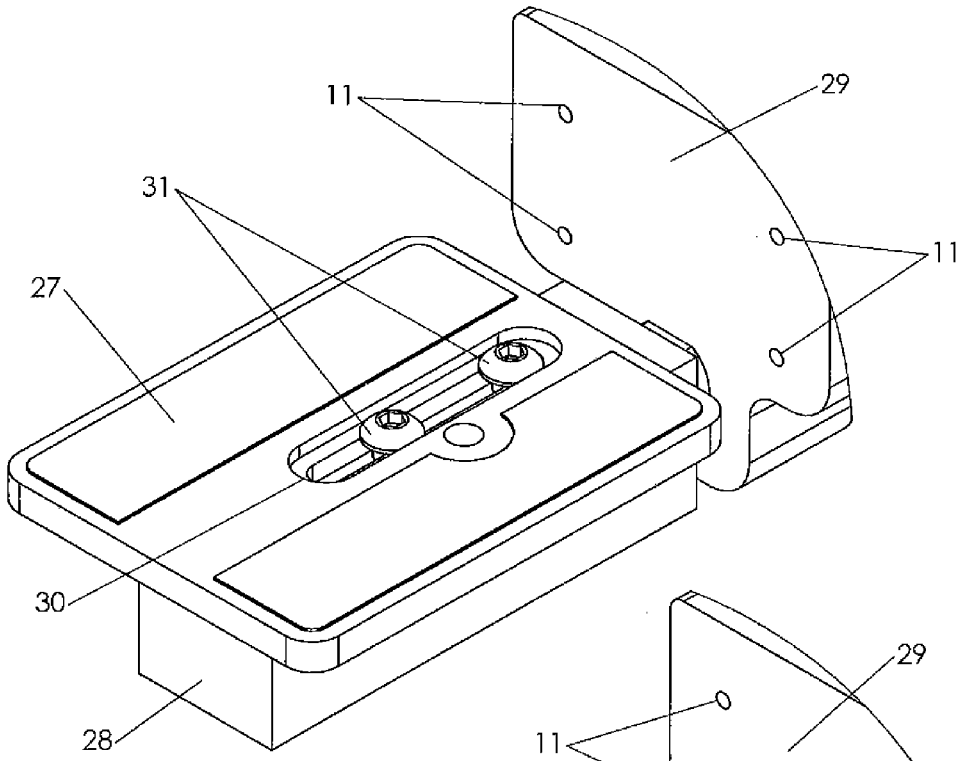
FIG. 7 is a detail view of the pedal assembly of the present invention in a first position.
Figure 8:
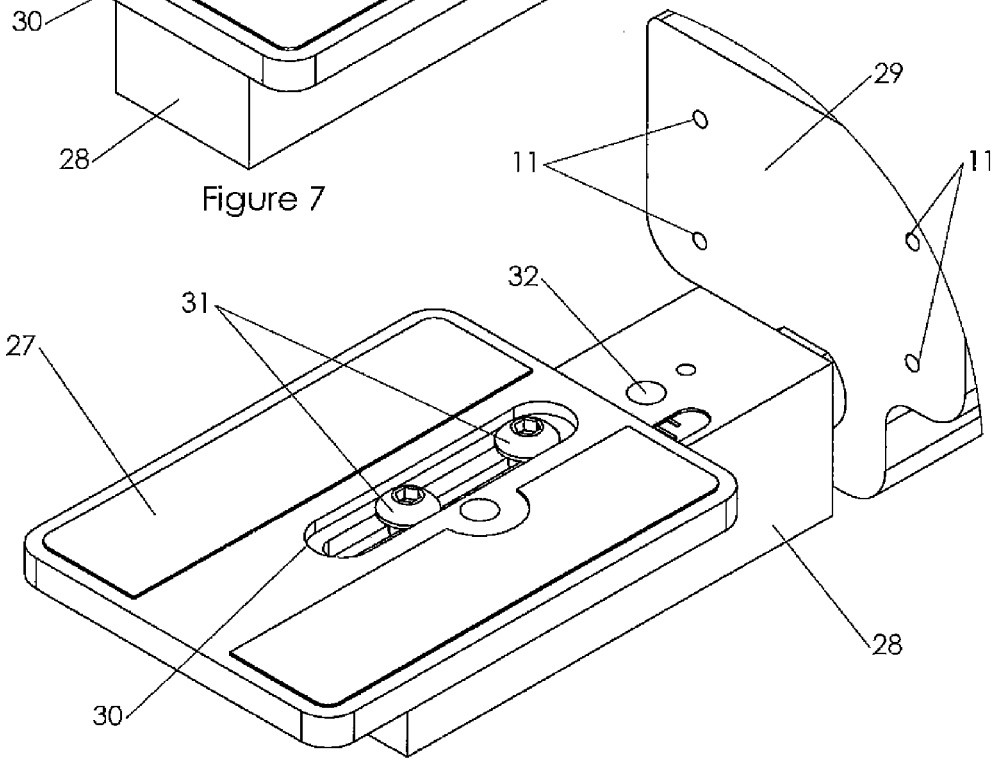
FIG. 8 is a detail view of the pedal assembly of the present invention in a second position.
Figure 9:
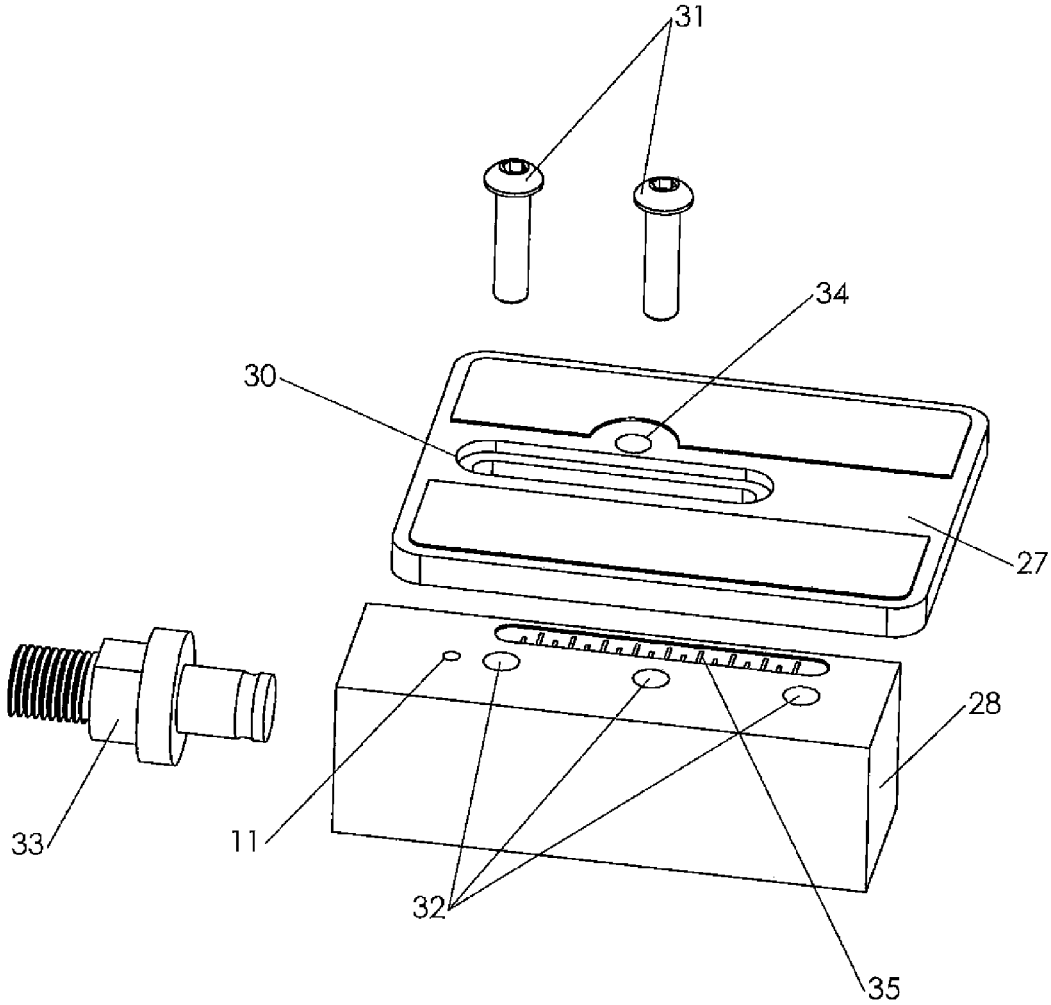
FIG. 9 is an exploded view of the pedal assembly of the present invention.

The pedal assembly is discussed more fully in connection with FIGS. 7-9.

Figure 2:
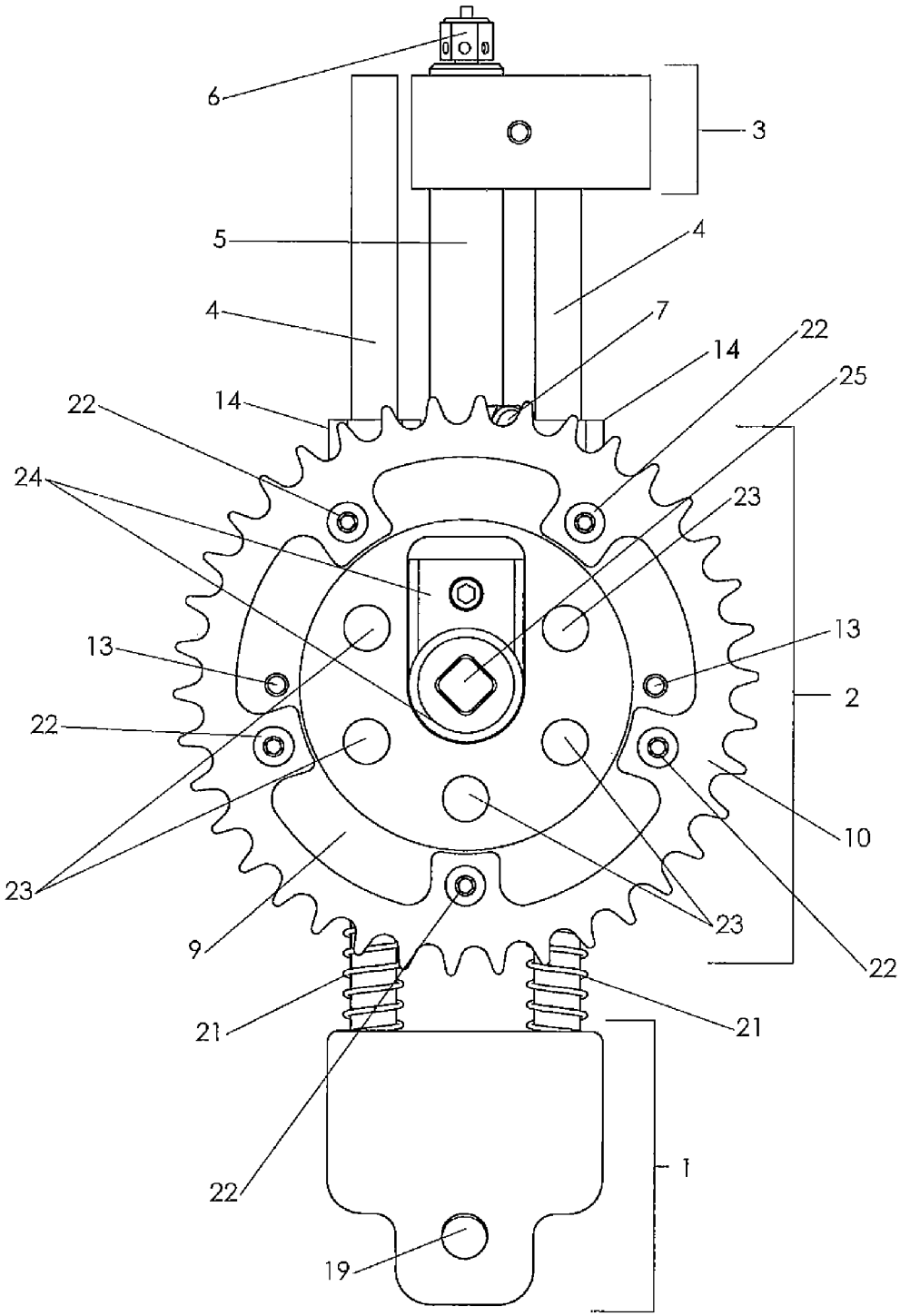
FIG. 2 is a back view of the rehab crank of the present invention.
Figure 3:
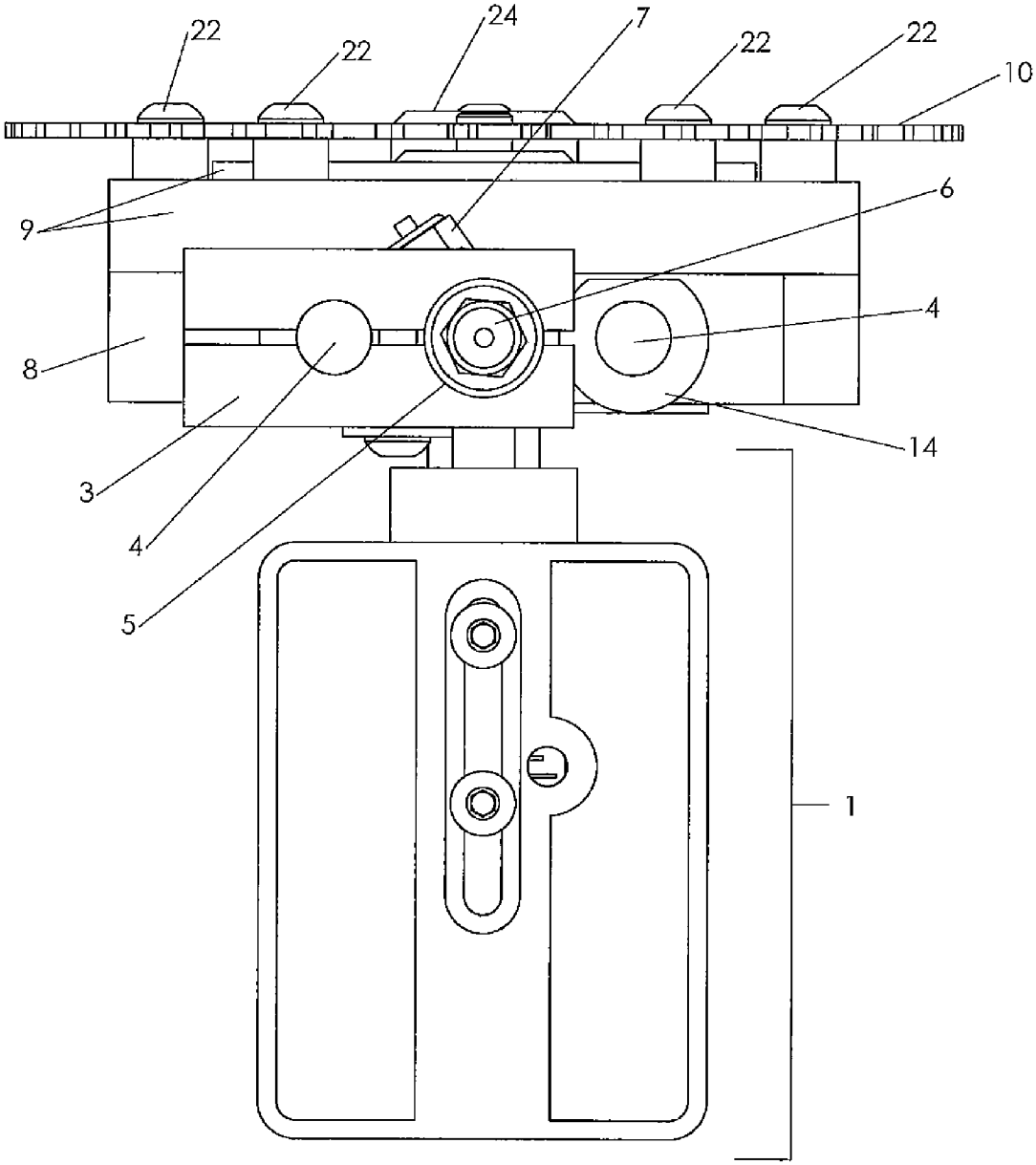
FIG. 3 is a top view of the rehab crank of the present invention.
Figure 4:
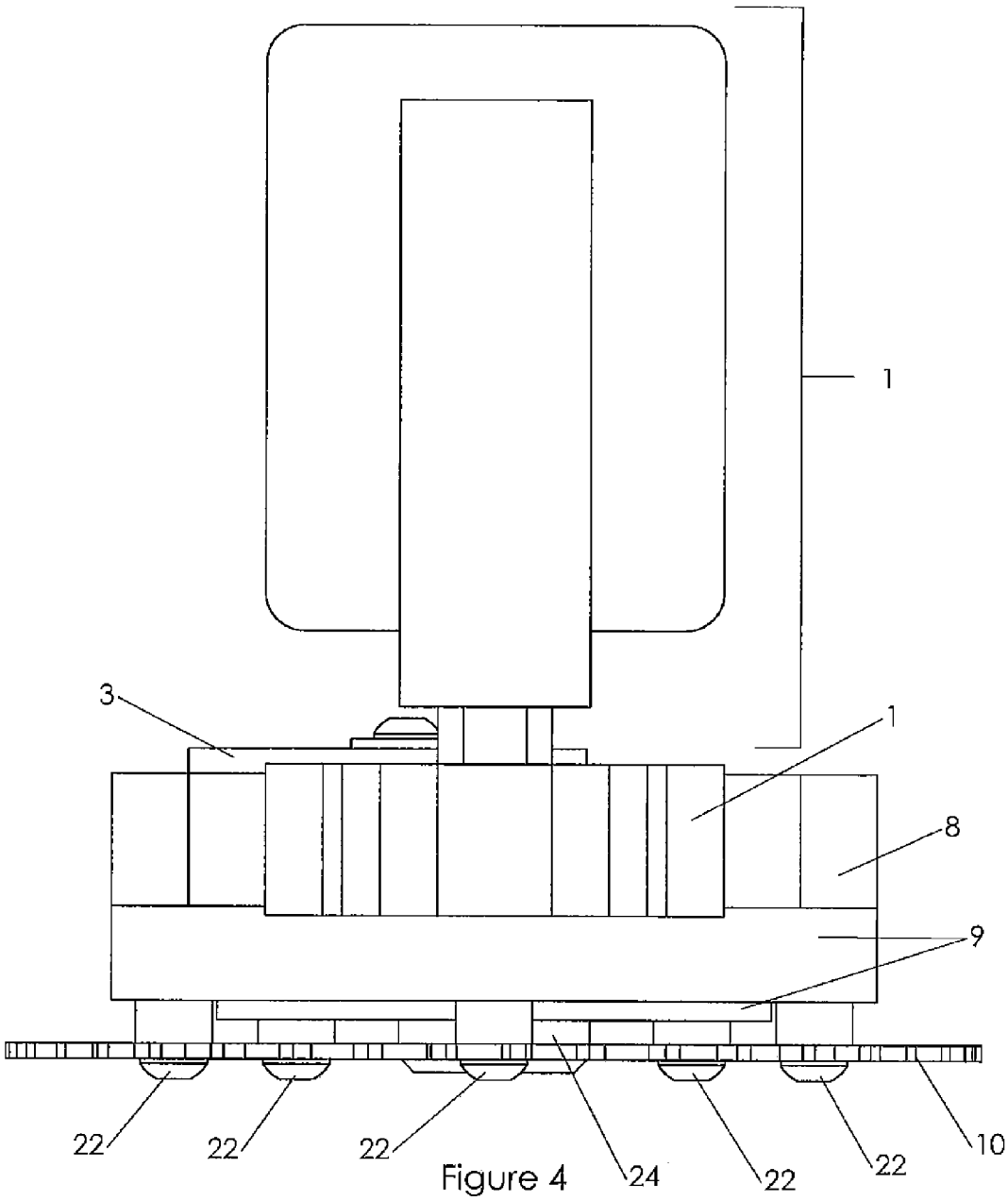
FIG. 4 is a bottom view of the rehab crank of the present invention.
Figure 5:
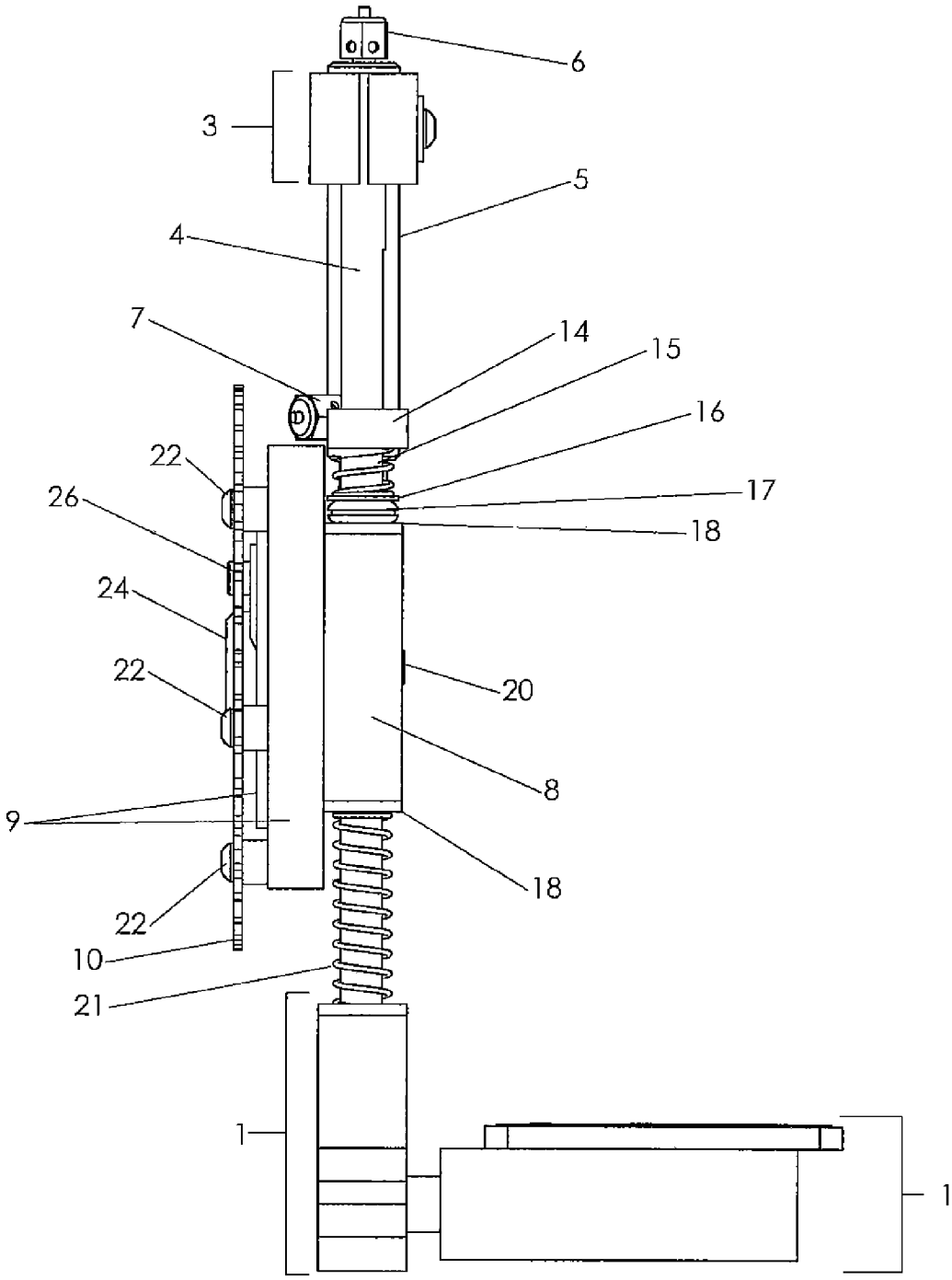
FIG. 5 is a right side view of the rehab crank of the present invention.
Figure 6:
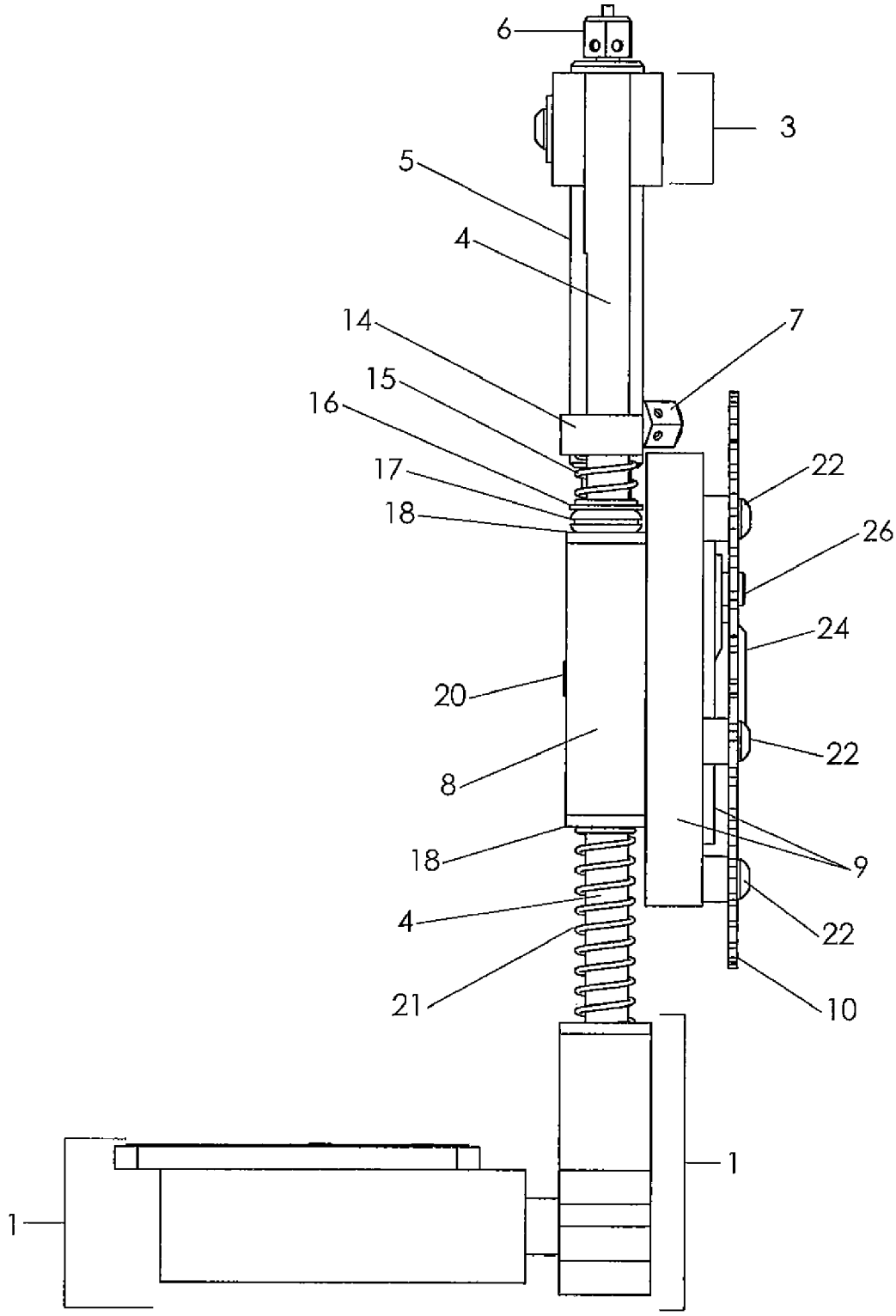
FIG. 6 is a left side view of the rehab crank of the present invention.

FIG. 2 is a back view of the rehab crank of the present invention. As shown in this figure, the chain ring 10 is attached to the secondary member 9 by a plurality of bolts 22. The present invention encompasses both a right-hand and a left-hand version of the rehab crank. The right-hand version is shown in FIG. 1-17. The left-hand version would be the same as the right-hand version except that the chain ring 10 would be removed.

FIG. 2 shows a plurality of cutouts 23 in the secondary member 9. These cutouts are optional and are for the purpose of reducing the overall weight of the rehab crank. FIG. 2 also shows the crank arm 24, which is used to attach the rehab crank to a cycle. The crank spindle (not shown) of the cycle is inserted into the crank spindle opening 25 of the crank arm 24. A holding screw 26 attaches the crank arm 24 to the secondary member 9. Also shown in FIG. 2 are the two adjustment screws 13 that attach the primary member 8 (not shown) to the secondary member 9.

FIGS. 3-6 are a top view, a bottom view, a right side view, and a left side view, respectively, of the rehab crank of the present invention.

FIGS. 7 and 8 are detail views of the pedal assembly 3 of the present invention. The pedal assembly comprises a pedal plate 27, a pedal base 28, and a housing 29. The housing 29 comprises four set screws 11 for the rods 4 (not shown). The pedal plate 27 comprises a slot 30 through which two pedal screws 31 extend. The pedal screws 31 attach the pedal plate 27 to the pedal base 28. The position of the pedal plate 27 on the pedal base 28 can be adjusted by moving the loosening the pedal screws 31, sliding the pedal plate 27 to the right or left, and retightening the pedal screws 31. In addition to shifting the pedal plate 27 to the right or left, the pedal plate can also be moved to a first or second position. FIG. 7 shows the pedal screws 31 in a first position. FIG. 8 shows the pedal screws 31 in a second position. There are three screw holes 32 (only one of which is shown in FIG. 8) on the pedal base 28. The pedal plate 27 can be moved from the first to the second position, or vice versa, by moving the pedal screws from one set of screw holes 32 to another (as further illustrated in FIG. 9).

FIG. 9 is an exploded view of the pedal assembly 3 of the present invention. As shown in this figure, the pedal base 28 is attached to the housing 29 (not shown) by a spindle bolt 33. A set screw 11 holds the spindle bolt 33 in the pedal base 28. The pedal plate 27 optionally comprises a window 34 through which a measurement scale 35 can be viewed for purposes of adjusting the position of the pedal plate 27 on the pedal base 28.

Figure 10:
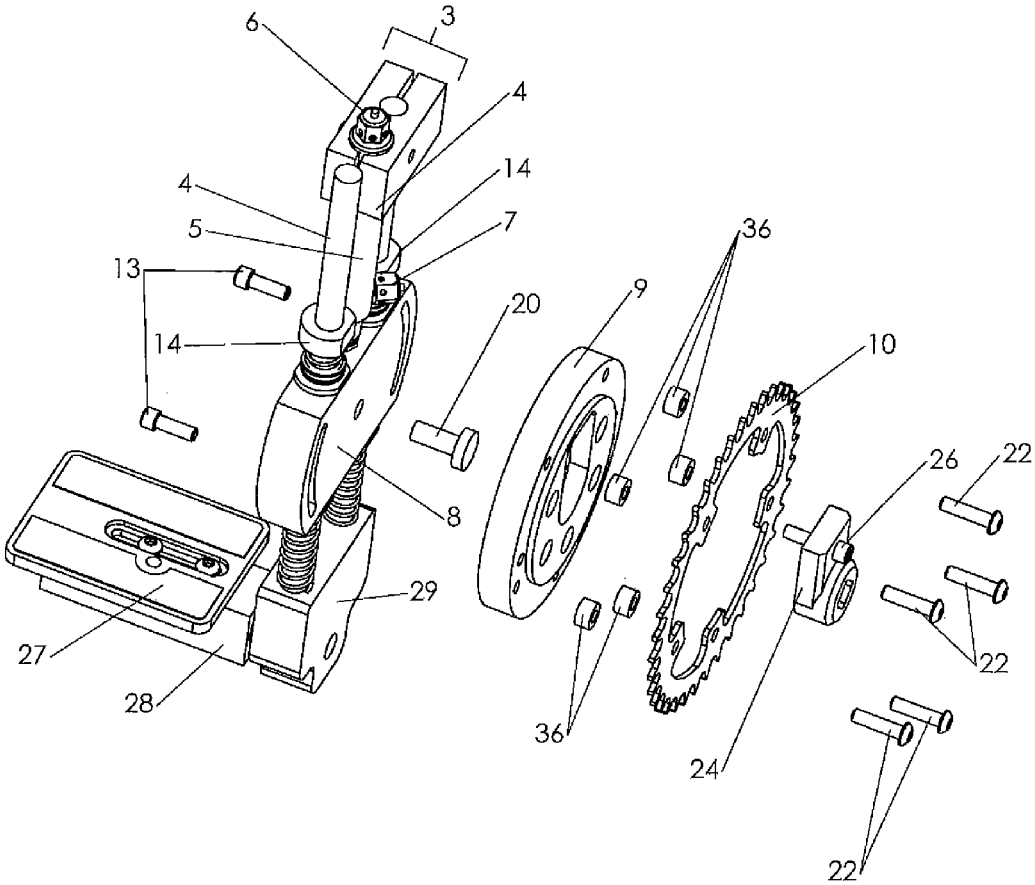
FIG. 10 is an exploded view of the center assembly of the present invention.

FIG. 10 is an exploded view of the center assembly 2 of the present invention. The various parts shown in this figure have been discussed previously, with the exception of the central hub 20 and the spacers 36. The central hub 20, together with the two adjustment screws 13, is used to attach the primary member 8 to the secondary member 9. The spacers 36 are situated between the chain ring 10 and the secondary member 9. The purpose of the spacers 36 is to ensure that the chain ring 10 does not lie flat up against the secondary member 9 in order to make it easier to fit the cycle chain 37 (shown in FIG. 13) around the chain ring 10.

Figure 11:
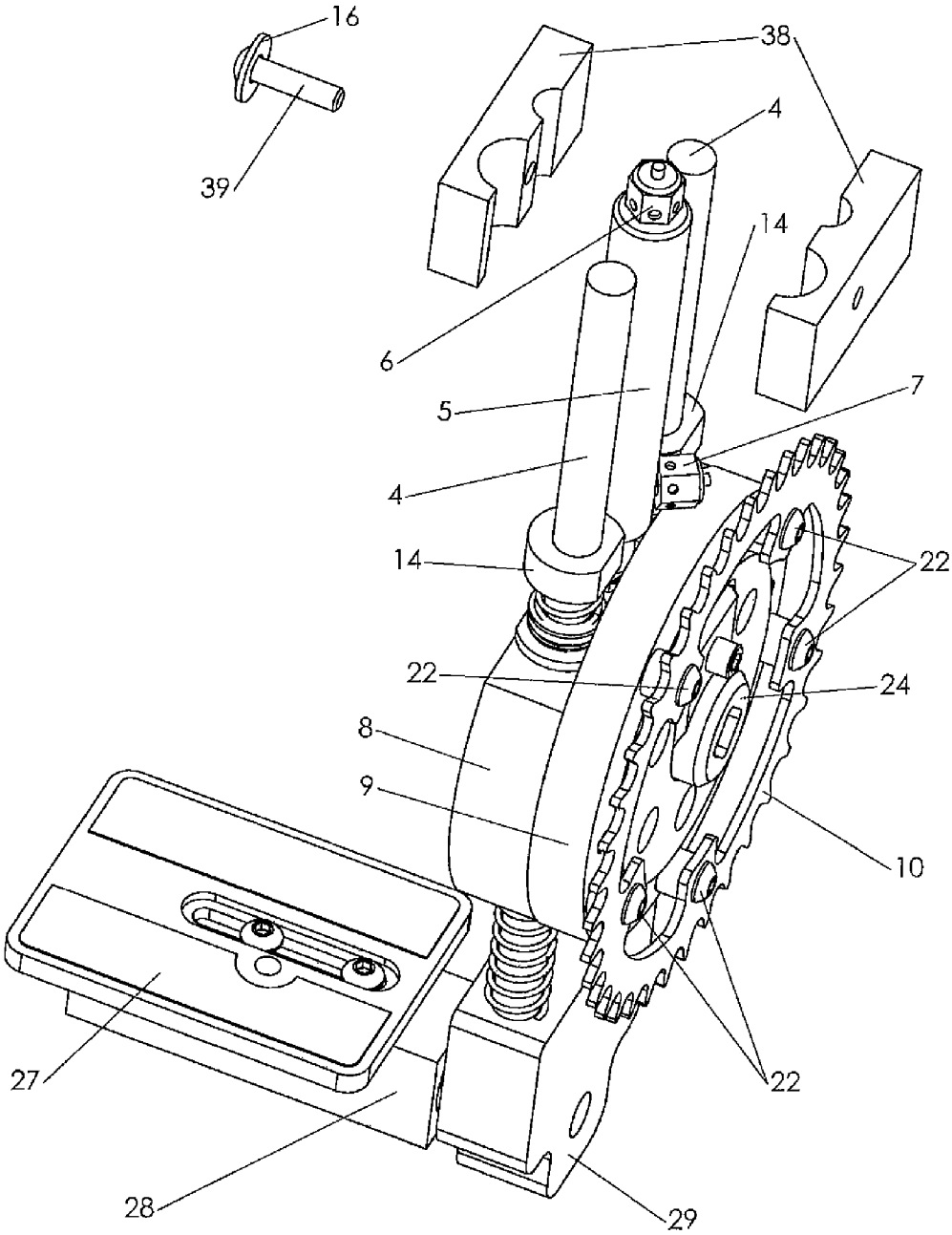
FIG. 11 is an exploded view of the anchor assembly of the present invention.

FIG. 11 is an exploded view of the anchor assembly 3 of the present invention. The anchor assembly 3 comprises two support pieces 38, an anchor screw 39, and an optional washer 16. The support pieces 38 fit on either side of the pneumatic cylinder 5 and at least one of the rods 4. The anchor screw 39 holds the two support pieces 38 together. The anchor assembly could consist of one or more support pieces, and the present invention is not limited to any particular number of support pieces.

Figure 12:
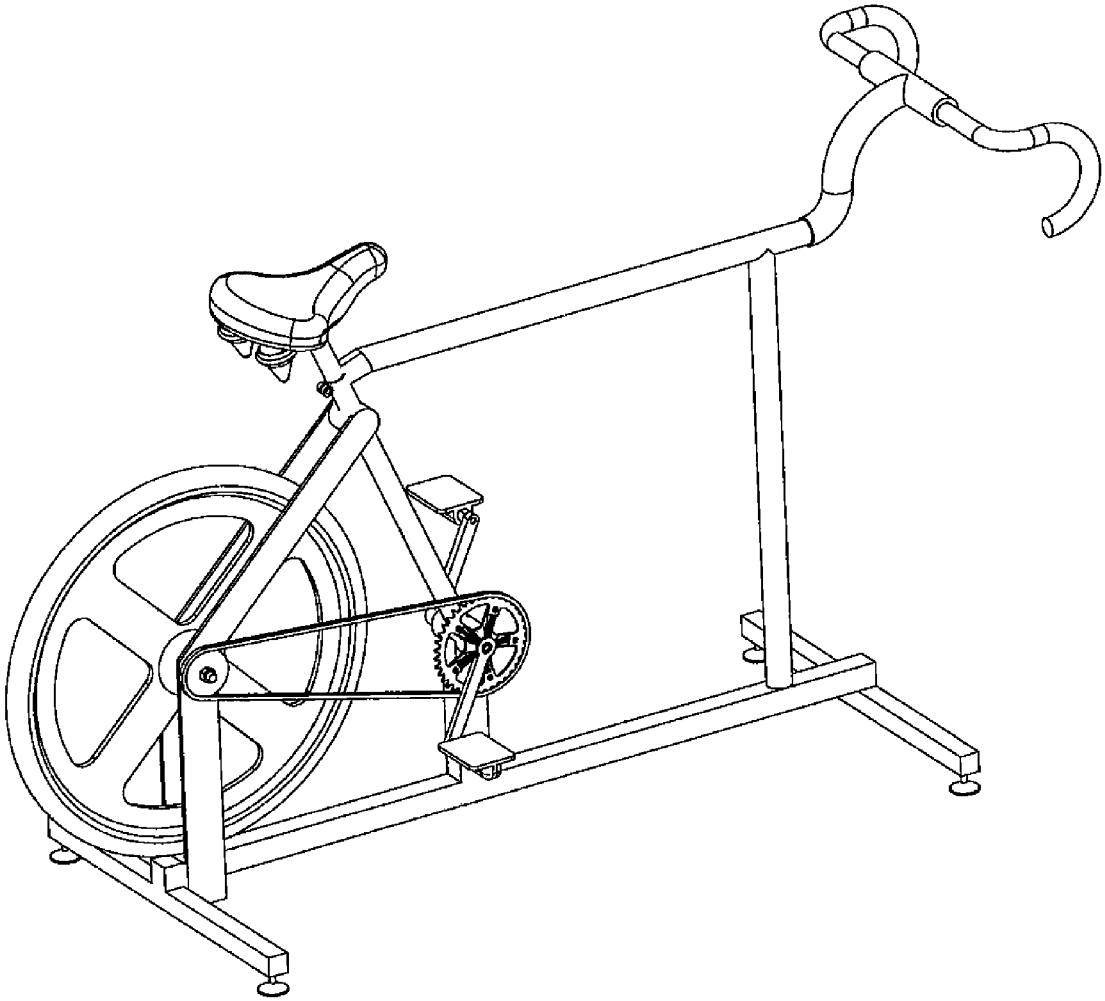
Figure 12 PRIOR ART
FIG. 12 is a perspective view of a stationary cycle with a standard (prior art) crank.
Figure 13:
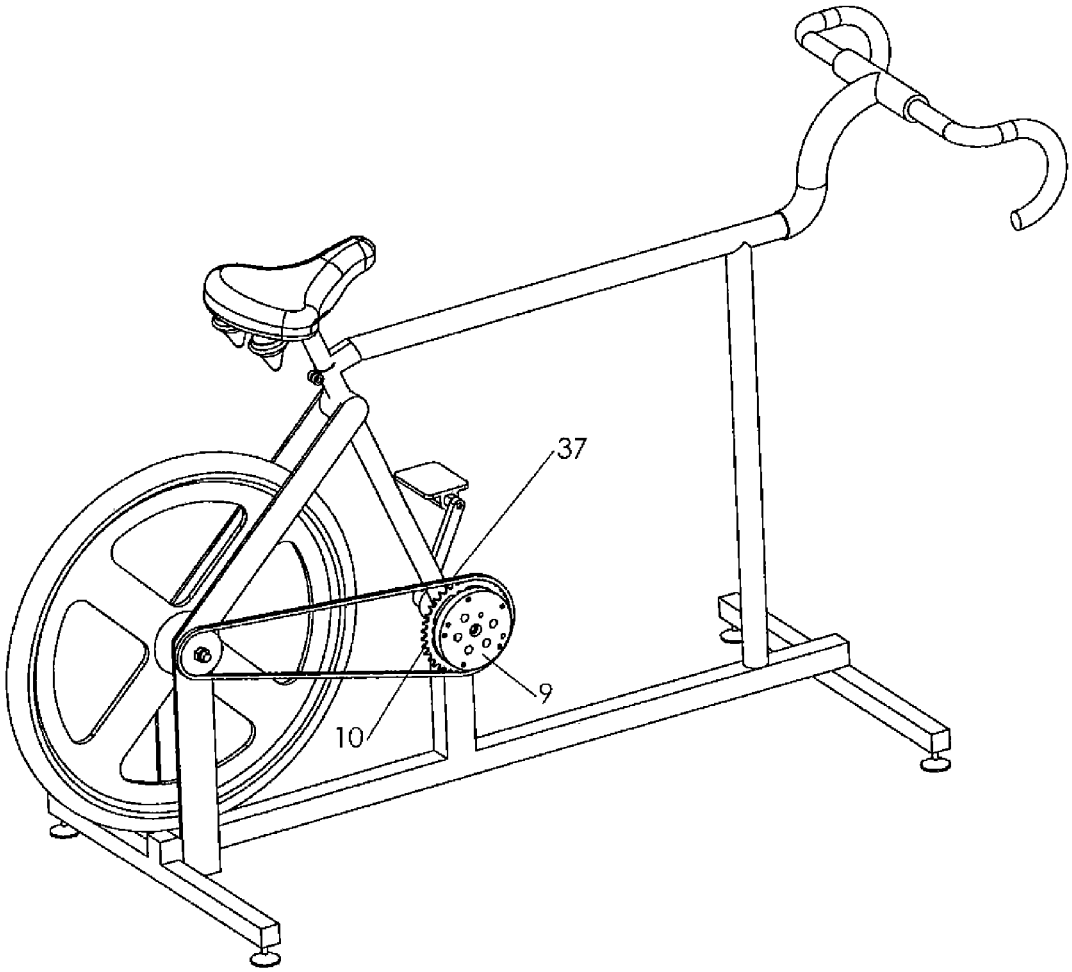
FIG. 13 is a perspective view of a stationary cycle with the chain ring 10 and secondary member 9 of the rehab crank of the present invention installed on the cycle.

FIGS. 14-17 illustrate the rehab crank of the present invention installed on a cycle. For comparison purposes, FIG. 12 is a perspective view of a stationary cycle with a standard (prior art) crank. To install the rehab crank on a cycle, the standard cycle crank is removed (in this case, on the right-hand side of the cycle), and the crank spindle (not shown) on the cycle is inserted into the crank spindle opening 25 (shown in FIG. 2) of the crank arm 24. FIG. 13 shows a cycle with just the chain ring 10 and secondary member 9 installed on the cycle. Next, the central hub 20 (shown in FIG. 10) is inserted into the secondary member 9, and the primary member 8 is fitted onto the central hub 20. The adjustment screws 13 are inserted into the slots 12 in the primary member 8 and screwed into the secondary member 9.

Figure 14:
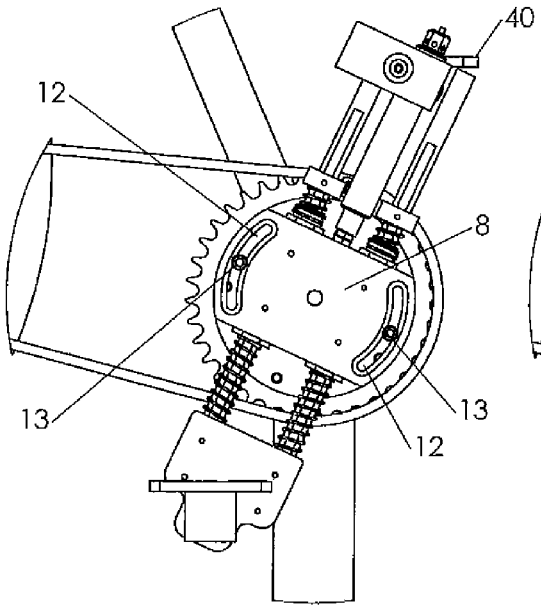
FIG. 14 is a detail view of the rehab crank of the present invention installed on a cycle at zero degrees advanced.
Figure 15:
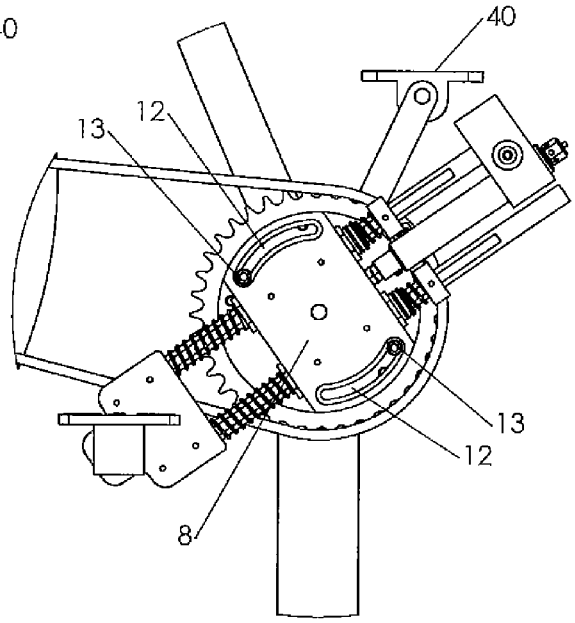
FIG. 15 is a detail view of the rehab crank of the present invention installed on a cycle at thirty degrees advanced.

FIGS. 14 and 15 illustrate the function of the adjustment screws 13 in advancing the rehab crank. Advancement of the rehab crank can be used to accommodate limitations in joint flexion on the part of the individual riding the cycle. FIG. 14 shows the rehab crank advanced zero degrees; in other words, the rehab crank is at the same angle as the pedal 40 on the opposite side of the cycle. FIG. 15 shows the rehab crank advanced thirty degrees; in other words, the rehab crank is thirty degrees forward of the pedal 40 on the opposite side of the cycle. The degree of advancement can be adjusted by loosening the adjustment screws 13, sliding the adjustment screws 13 within the slots 12 on the primary member, and then retightening the adjustment screws 13. In so doing, the primary member 8 is allowed to rotate on the central hub 20, thereby rotating the primary 8 member with respect to the secondary member 9.

Figure 17:
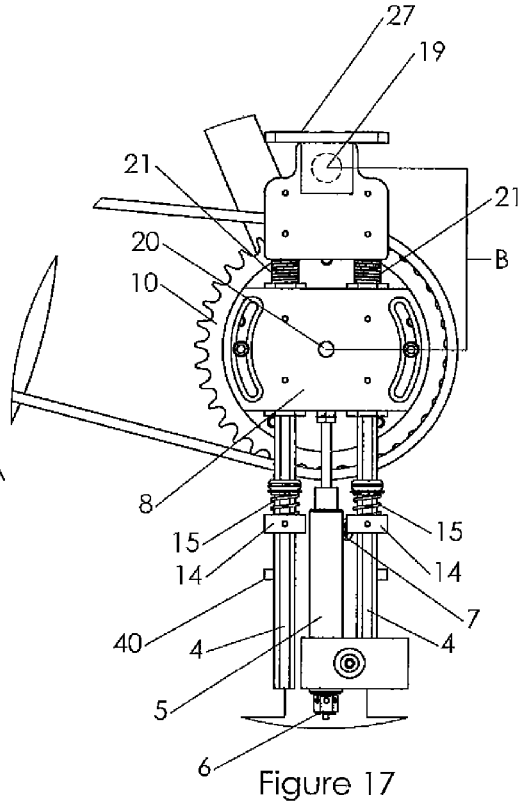
FIG. 17 is a detail view of the rehab crank of the present invention installed on a cycle with the pedal in an up stroke position.

FIGS. 16 and 17 illustrate the active component of the present invention in allowing the crank to be extended on the down stroke and compressed on the up stroke. This extension and compression motion is enabled by the combination of the pneumatic cylinder 5 and the rods 4 that slide through the primary member 8. In the down stroke position, shown in FIG. 16, the rods 4 are fully extended downward, to the extent permitted by the limitation collars 14 and first springs 15. In the up stroke position, shown in FIG. 17, the rods 4 are again fully extended downward, but this time in the opposition direction from the pedal 27. As shown in FIGS. 16 and 17, the pneumatic cylinder is fully extended when the crank is in the up stroke position (FIG. 17) and fully retracted when the crank is in a down stroke position (FIG. 16). The ease with which the pneumatic cylinder 5 is extends and retracts can be adjusted by opening or closing the air intake valve 6 and air outlet valve 7.

In the preferred embodiment, all parts of the rehab crank are constructed of aluminum, with the exception of the rods 4, which are steel, the rubber bumpers 17, and the brass bushings 18. The air intake 6 and air outlet 7 valves may be comprised of any suitable material, including, but not limited to, brass or PVC plastic.

As illustrated by the above discussion, the rehab crank of the present invention has four primary methods of adjustment. The first is the ability to adjust the length of extension on the crank by moving the limitation collars 14 on the rods 4, as explained above in connection with FIG. 1. The second is the active extension-compression motion afforded by the slidable rods 4 and pneumatic cylinder 5. This motion is discussed above in connection with FIGS. 16 and 17. The third is the capability of advancing the crank, as discussed in connection with FIGS. 14 and 15. The fourth is the medial-lateral adjustability of the pedal plate 27 on the pedal base 28, as discussed in connection with FIGS. 7-9. This combination of features provides the physician or rehab technician with the maximum flexibility in accommodating a patient with limited knee, hip or ankle flexion, and it allows the rider to achieve smooth cadence despite his or her physical limitations.

Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. A rehab cycle crank comprising:

(a) a pedal assembly;

(b) a center assembly;

(c) an anchor assembly;

(d) two rods; and (e) a pneumatic cylinder;

wherein the pedal assembly comprises a pedal plate, a pedal base, and a housing;

wherein the center assembly comprises a primary member and a secondary member;

wherein the anchor assembly comprises at least one support piece;

wherein each rod comprises a first end and a second end;

wherein the pneumatic cylinder comprises a first end and a second end;

wherein the housing of the pedal assembly is connected to the first end of each rod;

wherein the anchor assembly is connected to the second end of at least one of the rods and the second end of the pneumatic cylinder;

wherein the rods extend slidably through the primary member of the center assembly;

wherein the primary member is attached to the secondary member by a central hub;

wherein the secondary member comprises a crank arm;

wherein the crank arm comprise a crank spindle opening; and wherein the rehab cycle crank is adapted to be attached to a crank spindle of a cycle such that the crank spindle of the cycle can be inserted into the crank spindle opening of the crank arm.

2. The rehab cycle crank of claim 1, further comprising a chain ring.

3. The rehab cycle crank of claim 2, wherein the chain ring is attached to the secondary member by a plurality of bolts.

4. The rehab cycle crank of claim 3, further comprising at least one spacer between the secondary member and each bolt.

5. The rehab cycle crank of claim 1, further comprising two springs, wherein the springs are located on the rods between the housing of the pedal assembly and the primary member.

6. The rehab cycle crank of claim 1, further comprising two rubber bumpers.

7. The rehab cycle crank of claim 1, further comprising two limitation collars.

8. The rehab cycle crank of claim 1, further comprising two or more brass bushings, wherein the brass bushings provide lubrication for the rods as they slide through the primary member.

9. The rehab cycle crank of claim 1, further comprising two limitation collars, wherein one limitation collar is located on each rod between the primary member and the anchor assembly, and wherein the position of the limitation collars on the rod can be adjusted.

10. The rehab cycle crank of claim 9, further comprising two springs, wherein the springs are located on each rod between the primary member and the limitation collar.

11. The rehab cycle crank of claim 9, further comprising two rubber bumpers, wherein the rubber bumpers are located on each rod between the primary member and the limitation collar.

12. The cycle crank of claim 1, further comprising two or more set screws, wherein the set screws are located on the primary member, and wherein the set screws can be loosened or tightened to make it easier or harder to slide the rods through the primary member.

13. The cycle crank of claim 1, wherein the pneumatic cylinder comprises an air intake value and an air outlet valve, and wherein the ease with which the pneumatic cylinder extends and/or retracts can be adjusted by adjusting the air intake and/or air outlet valves.

14. The rehab cycle crank of claim 1, wherein the primary member comprises two arcuate slots, wherein in addition to being attached to the secondary member by a central hub, the primary member is also attached to the secondary member by two screws that extend through the slots in the primary member and into the secondary member, and wherein the angle of the crank when it is installed on a cycle can be adjusted by loosening the screws, rotating the primary member in relation to the secondary member, and retightening the screws.

15. The rehab cycle crank of claim 1, wherein the pedal plate comprises a slot, wherein the pedal plate is attached to the pedal base by one or more screws that extend through the slot in the pedal plate and into the pedal base, wherein the position of the pedal plate on the pedal base can be adjusted by loosening the screws, sliding the pedal plate laterally on the pedal base, and retightening the screws.

16. The rehab cycle crank of claim 1, wherein the pedal plate comprises a slot, wherein the pedal plate is attached to the pedal base by one or more screws that extend through the slot in the pedal plate and into the pedal base, and wherein the position of the pedal plate on the pedal base can be adjusted by loosening the screws, moving the pedal plate laterally on the pedal base, moving the screws to a second position from a first position, and retightening the screws.

* * * * *